United States Patent [19]

Robertson

[11] 4,322,005

[45] Mar. 30, 1982

[54] DISPLAY STACKER WITH BIASED PIVOTED TRAYS

[75] Inventor: David Robertson, Toms River, N.J.

[73] Assignee: Displayco, Newark, N.J.

[21] Appl. No.: 248,201

[22] Filed: Mar. 27, 1981

[51] Int. Cl.[3] ..... A47F 5/11

[52] U.S. Cl. ..... 211/49 S; 108/2; 108/136; 211/150

[58] Field of Search ..... 211/49 S, 49 R, 150, 211/135; 108/136, 18, 2; 16/76; 267/155

[56] References Cited

U.S. PATENT DOCUMENTS

| | | | |
|---|---|---|---|
| 2,716,495 | 8/1955 | Prevette el al. | 211/150 X |
| 2,917,180 | 12/1959 | Snyder | 211/49 S |
| 2,928,551 | 3/1960 | Abrams et al. | 211/90 X |
| 2,950,820 | 8/1960 | Shiels | 108/2 |
| 2,982,419 | 5/1961 | Shiels | 211/49 S |
| 2,992,742 | 7/1961 | Pendergrast | 211/49 S |
| 3,045,831 | 7/1962 | Pendergrast et al. | 211/49 S |
| 3,137,251 | 6/1964 | Pendergrast et al. | 211/49 S |
| 3,151,744 | 10/1964 | Patterson | 211/49 S |
| 3,161,158 | 12/1964 | Lurey | 211/49 S X |
| 3,403,789 | 10/1968 | LaMorte et al. | 211/150 |
| 3,616,938 | 9/1969 | McAleenan et al. | 211/49 S X |
| 3,677,203 | 7/1972 | Barrineau | 211/49 S X |
| 3,688,914 | 9/1972 | Taber | 211/49 S |
| 4,151,803 | 5/1979 | Ferrera et al. | 211/135 X |
| 4,159,831 | 7/1979 | Schorr | 211/49 D |

FOREIGN PATENT DOCUMENTS

| | | | |
|---|---|---|---|
| 56946 | 8/1912 | Austria | 16/76 |
| 21464 | of 1914 | United Kingdom | 16/76 |

*Primary Examiner*—Roy D. Frazier
*Assistant Examiner*—Robert W. Gibson, Jr.
*Attorney, Agent, or Firm*—Ward, Lalos, Leeds, Keegan & Lett

[57] ABSTRACT

A corrugated paper display stacker having a plurality of vertically arranged springs and upwardly biased pivoted trays secured to a back panel. A double acting torsion spring having hooks on protruding fingers that are inserted into the fluting of the tray and a stablizing U-shape loop on the other side of the spring maintain each of the trays in a vertical position when not loaded with merchandise. The torsion spring is held to the back panel by securing means in the form of a dowel.

16 Claims, 6 Drawing Figures

DISPLAY STACKER WITH BIASED PIVOTED TRAYS

GENERAL BACKGROUND

The present invention relates generally to display devices. Most particularly the present invention relates to corrugated paper display devices used for exhibiting packaged material particularly rigid containers of liquid or solid materials.

It is common for display devices of commodities to be sold in retail food or department stores to be used for what is often referred to as an end aisle stacker. Such stacker of the commodities is positioned up against the usual permanent shelves forming an aisle through which the prospective purchaser passes. These end aisle stackers are particularly important because the traffic flow of the prospective purchasers across or around the end of the aisle is greater than the traffic flow through any one particular aisle. For this reason the end aisle stackers are important elements in the display of commodities to be sold as they command a preferred location up against the end of the aisle but may of course be useful in any other location.

Often times, an end aisle stacker would constitute simply a base and rear panel forming a frame for the goods stacked in rows one upon another in front of the back panel that is situated against the end of the aisle. With such rows or stacks of commodities the shapes of the containers and the spacing provided between adjacent containers in any row often requires the use of a tray or divider positioned between adjacent vertical rows forming the stack of the goods being displayed.

These dividers are often made of inexpensive materials such as corrugated paper however they are designed to be reused after the first stack has been removed by the purchasers and the stacker reloaded. Experience has shown, however, that the dividers are frequently disposed of by the food store clerks after each row of the stack has been removed. The resupplier of the stacker who is usually the detail or route man employed by the manufacturer or bottler of the goods being stacked must in such cases maintain a continuing supply of these dividers thus adding to the expense of the display but more importantly requiring the route man to have always at hand a supply of these dividers. In many instances, such a supply of dividers is not maintained.

Without a sufficient supply of new dividers to replace those that were discarded, it is not possible to stack the commodities in rows thus defeating the purpose of the end aisle stacker.

Simply retaining the trays as dividers on the display unit could be considered to be a possible solution. There are, for instance, a number of display racks that have been used in the past for stacking goods and yet not permit the trays or dividers to be removed and discarded. Among this type of display rack may be included Abrams U.S. Pat. Nos. 2,928,551, Shiels 2,982,419, Pendergrast 2,992,742 and 3,045,831, 3,137,251.

These patents mentioned above are simply examples of a great many patents relating to display racks that have a spring urged pivoted shelf. Each of these racks, however, is expensive to manufacture and often does not lend itself to the use of pictorial representations as well as a display rack of corrugated paper.

Corrugated paper display units are well known and have been used for many years. Such racks may be imprinted with attractive designs and representations that are appealing to the eye of the prospective purchaser and therefore are frequently viewed by the retail store as a desirable adjunct to the permanent aisle displays. These corrugated paper display units may be used as end aisle stackers but there is no provision for retaining the required dividers or trays between adjacent rows. More importantly, there never has been any corrugated paper display stacker known in the art to have spring urged pivoted trays upon which the adjacent rows of the stack are positioned. The desirability of the continuously upwardly pivoted shelf is manifest to expose the filled shelf below after stock has been removed from the adjacent upper shelf yet no such display stacker formed from corrugated paper has been made available to the industry.

OBJECTS OF THE PRESENT INVENTION

One of the principal objects of the present invention is to provide a display stacker having continuously urged upwardly pivoted shelves all composed of corrugated paper.

A further object of the present invention is to provide a corrugated paper display stacker having continuously urged pivoted trays that cannot be easily removed from the display stacker.

A further object of the present invention is to provide a corrugated paper display stacker having spring biased pivoted trays that are held to the back panel of the stacker by a single spring means.

A further object of the present invention is to provide a torsion spring having fingers projecting in one direction that are embedded into the end of the cardboard tray of the display stacker and are retained so embedded by the use of hooks at the end of the fingers to prevent the disengagement of the fingers from the tray.

Another object of the present invention is to provide means for attaching the torsion spring constituting the means for continuously urging the corrugated paper tray upwardly when used with the display stacker by projecting the spring through the back panel and securing the spring on the side of the panel opposite to the tray.

Yet a further object of the present invention is the provision of a stabilizing means in the form of a double torsion spring having a U-shaped loop bearing against one side of the back panel and spaced fingers on the spring embedded into one end of the tray to provide stability which along with vertical side panels adjacent the back panel limits the vertical pivotal movement of the trays.

These and other objects of the present invention will be manifest upon careful consideration of the following specification including the drawings as follows.

SUMMARY OF THE INVENTION

A display stacker preferably of corrugated paper having a base with back and side panels and a plurality of vertically arranged trays secured to the back panel for pivotal movement between the side panels. Each of the trays is secured to the panel by a torsion spring having a pair of fingers on one side with hooks for embedment along the fluting of the corrugated paper tray to secure the tray to the spring and at the opposite end of the spring there is positioned a stabilizing means in the form of a connecting U-shaped loop for contact with the back panel and a pair of coil springs between the fingers and the stabilizing means for projecting through the back panel. Securing means that may be in the form of dowel means passing through the coils is positioned on the side of the back panel opposite to the stabilizing means and the fingers.

DESCRIPTION OF A PREFERRED EMBODIMENT

Figure 1:
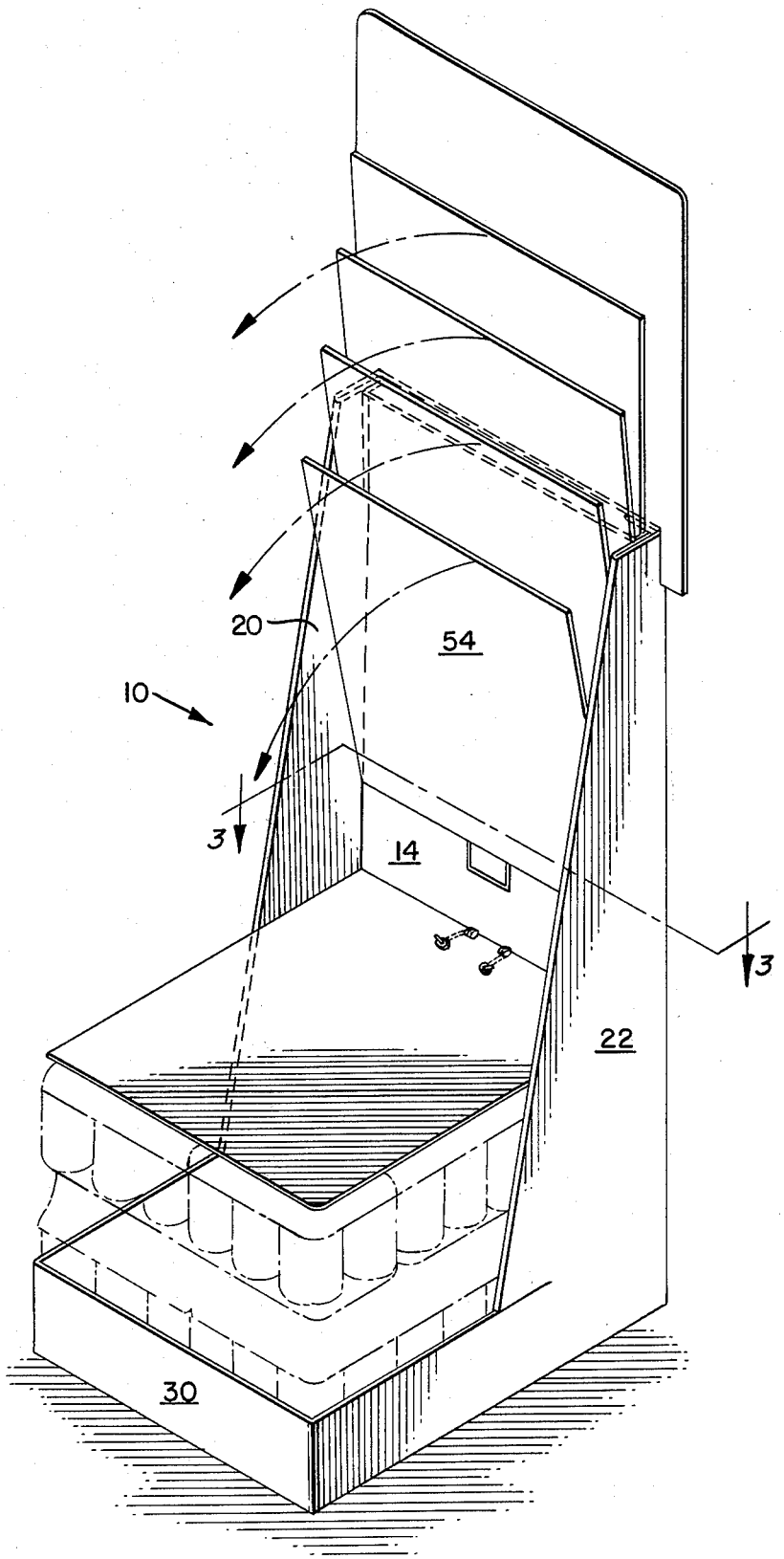
FIG. 1 is a perspective view of the display stacker of the present invention illustrating the action of the pivoting shelves from substantially vertical position to essentially horizontal position.
Figure 2:
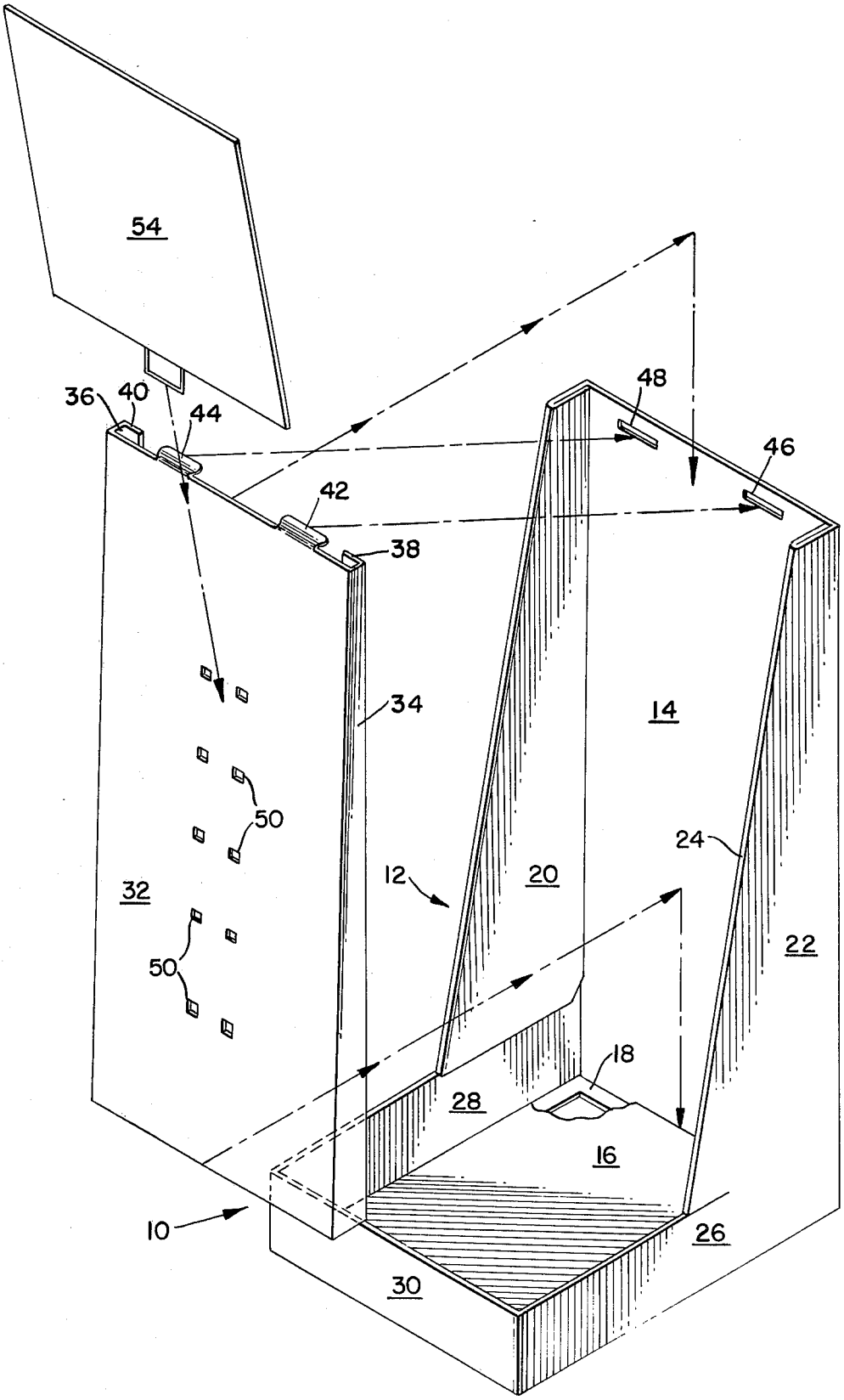
FIG. 2 is an exploded view in perspective of the display stacker of the present invention illustrating the assembly of the base and back panel and the positioning of the pivoting trays.
Figure 3:
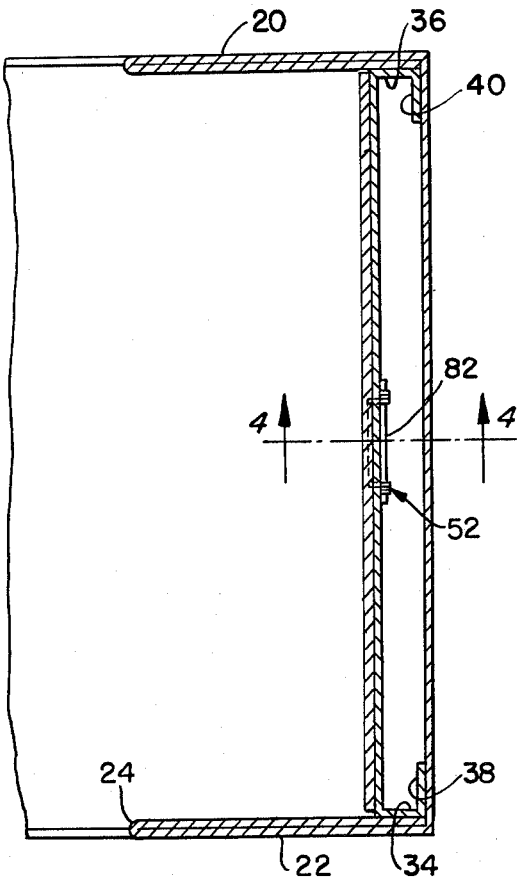
FIG. 3 is a cross-sectional view partly broken away taken along lines 3—3 of FIG. 1 and illustrating the securing means for the torsion spring of the present invention.

The display stacker of the present invention is shown generally at 10 in FIGS. 1 and 2. The display stacker is composed of a base as shown generally in FIG. 2 at 12. The base consists of a back panel 14 extending vertically the height of the base. Attached to the back panel 14 may be a bottom panel 16. Bottom panel 16 may also be detachable and not integral with any portion of the base. As shown in FIG. 2, bottom panel 16 rests on a perimeter bottom panel 18. Secured to the back panel 14 is a pair of side panels 20 and 22 which are for a majority of their vertical extent doubled back on each other as may be seen in FIG. 3. The purpose of folding these side panels back on each other along the line 24 is to strengthen the side panels and to prevent the panels from separating laterally. Each of the side panels is provided with an inclined leading edge at the fold line 24. Towards the bottom of each of the side panels, vertical frame panels 26 and 28 are positioned which are integral with the side panels 20 and 22 and preferably are also integral with the back panel 14. The side frame panels 26 and 28 and front frame panel 30 form the base frame for which the bottom panel 16 is sized and received.

Spaced from the back panel 14 is a rear panel 32 coextensive in length and width with the back panel 14 as best seen in FIG. 2. The rear panel 32 has a pair of spacer panels 34 and 36 which extend the full vertical height of the rear panel 32. Connected to the spacer panels are abutment panels 38 and 40 which are designed to be in intimate contact and abut the rear panel 32. As shown in FIG. 2, the spacer panels 34 and 36 may be wider at the base than at the top so as to incline slightly the rear panel 32 rearwardly. As best shown in FIG. 2, rear panel 32 is provided with a pair of tabs 42 and 44 designed to be received into accommodating slots 46 and 48 provided in the top of the back panel 14. This combination of tabs and slots secures the rear panel 32 to the back panel 14.

The face of the rear panel 32 is provided with a plurality of vertically arranged pairs of openings 50. These openings are aligned vertically and the individual openings of any pair are aligned horizontally and spaced to receive the torsion spring 52 holding the upwardly pivoting trays 54.

The trays 54 are vertically arranged in front of the rear panel 32 and vertically spaced predetermined distances in accordance with the merchandise stacked on the trays. Each of the trays is formed preferably from corrugated paper and pivoted vertically about the torsion spring 52 within the lateral limits and confines provided by the side panels 20 and 22.

Figure 4:
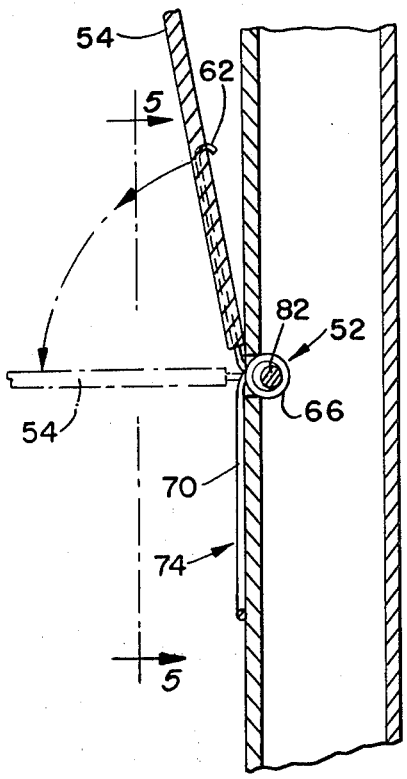
FIG. 4 is a cross-sectional view partly broken away and taken along lines 4—4 of FIG. 3 and illustrating the horizontal position of the tray in phantom lines and the substantially vertical position of the tray in solid lines.
Figure 5:
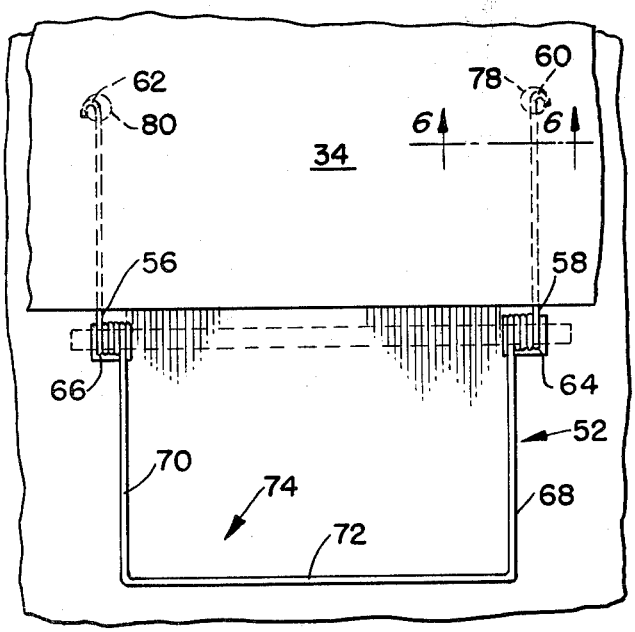
FIG. 5 is a vertical view of the present invention taken along lines 5—5 of FIG. 4 illustrating the positioning of the hooks in the end of the tray.

The torsion spring 52 as best shown in FIGS. 4 and 5 is a double acting torsion spring having a pair of projecting fingers 56 and 58. At the end of each of the fingers there is provided a deformation in the form of a hook 60 and 62. At the opposite end of the fingers 56 and 58 from the hook 60 and 62 are coils 64 and 66. The coils are formed from a plurality of revolutions of the wire being bent to form the coil. Protruding from the coils at the opposite end from the fingers 56 and 58 are a pair of spaced legs 68 and 70 extending out from the coils 64 and 66, preferably and approximately, the same length as the fingers 56 and 58. Adjoining the legs 68 and 70 there is a cross member 72 forming with the legs 68 and 70 in a U-shaped planar loop, shown generally at 74.

Figure 6:
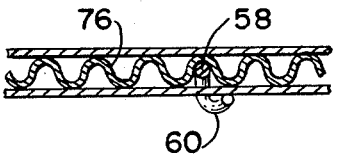
FIG. 6 is a cross-sectional view partly broken away taken along lines 6—6 of FIG. 5 and illustrating the spring wire passed within the fluting of the corrugated paper tray.

The wire forming the torsion spring 52 is preferably of sufficiently small diameter to pass between the fluting 76 of the conventional corrugated paper board, as best shown in FIG. 6. Such a size wire is appropriately known as "flute wire". The fingers 56 and 58 are inserted with the hook end 60 and 62 into the end of the corrugated paper until the hook reaches the holes 78 and 80 provided in the top face of each of the trays, as best shown in FIG. 5. The hooks 60 and 62 are designed to be received into the accommodating holes 78 and 80 and have a portion of the hooks 60 and 62 lap over on the outside of the receiving holes 78 and 80 to hold the tray securely to the spring 52. Any effort to pull the tray outwardly from the spring will be resisted by the hooks 60 and 62 bearing against the holes 78 and 80 of the tray.

Once the fingers 56 and 58 are inserted into the fluting of the corrugation of the tray 54 and the hooks 60 and 62 properly disposed out of the receiving holes 78 and 80, the coils 64 and 66 of the torsion spring 52 are inserted into the accommodating pair of openings 50, as best shown in FIGS. 4 and 5. Each of the trays with its appropriate torsion spring is in turn to be projected through the face of the back panel 32. As soon as the spring coils 64 and 66 pass through the openings 50, securing means in the form of a dowel 82 is passed through the coils 64 and 66 and across the back of the rear panel 32 to hold the torsion spring 52 in position and permit the panels 54 to pivot upwardly about the coils 64 and 66 as an approximate axis.

It should be clear from the foregoing description that the individual trays are continually urged to pivot upwardly to a nearly vertical position and may be pulled down against the action of the spring 52 to a near horizontal position as shown in phantom lines in FIG. 4. When in the horizontal position, the trays 54 rest for support upon the merchandise stacked in the immediately lower shelf which in turn requires support from the shelves there below. The first row of merchandise to be stacked, preferably, in the form of containers of metal, glass or plastic containing usually liquids but also solids, is made by placing the merchandise on top of the bottom panel 16. The bottom of the lowermost panel 54 will rest upon the top of the containers placed in the bottom panel 16 and similarly each tray 54 receiving the next higher row of the stack of containers of merchandise will be supported by the lower stack. As can be seen, the vertical spacing between the pairs of openings 50 is predetermined by the height of the containers in any of the rows of the stack.

It should also be evident that as soon as the trays have the last container of merchandise removed the action of the torsion spring 52 will pivot the tray 54 slowly upwardly to near vertical position, as shown in FIG. 4, thus, exposing the next lower row of container merchandise. The trays 54 cannot be removed nor discarded when not supporting any row of container merchandise. Moreover, by pivoting upwardly to a vertical position, the tray does not obscure the merchandise below and remains ready to be again loaded with its row of merchandise after the display stacker has become empty.

It should be evident that the foregoing description has attained each of the objects set forth for the present invention and that the scope of the invention should be limited solely by the appended claims in which,

I claim:

1. A display stacker formed from reinforced paper material comprising a base to provide support for the stacker, a back panel on said base and rising vertically, side panels secured to said base and protruding outwardly from said back panel, a plurality of trays vertically arranged along said back panel for pivotal movement between said side panels, each said tray being secured to said back panel by a torsion spring, said torsion spring having a pair of fingers and each said fingers having an end thereof formed into a hook, and each said hook being passed through an end of said tray to secure said tray to said spring to permit said tray to pivot about said back panel whereby said fingers continually urge said tray upwardly toward a parallel position relative to said back panel when said tray remains unloaded and whereby said tray pivots downwardly toward a horizontal position against said spring for loading of said tray.

2. The display stacker of claim 1 including, said torsion spring having a stabilizing means positioned against said back panel.

3. The display stacker of claim 1 including, said torsion spring having a pair of coils secured to said fingers distal to said hooks, said coils being inserted through said back panel and securing means in contact with said back panel securing said spring to said back panel while permitting pivotal movement of said fingers and said tray.

4. The display stacker of claim 3 including, said securing means being a dowel means inserted into said coils, said dowel means being on the side of said back panel opposite to said fingers.

5. The display stacker of claim 2 including, said stabilizing means being a connecting loop extending between said fingers.

6. The display stacker of claims 1, 2, 3, 4 or 5 including, said display stacker being formed from corrugated paper having conventional fluting and said fingers of said spring being passed through said tray parallel to said fluting.

7. The display stacker of claim 6 including, said tray being provided with holding means to receive said hooks whereby to prevent said tray from being removed from said stacker.

8. The display stacker of claim 7 including, said connecting loop being a planar U-shape having a cross member and a pair of coextensive spaced legs connected to said cross member.

9. The display stacker of claim 3 including, said torsion spring having a stabilizing means positioned against said back panel, and said display stacker being formed from corrugated paper having conventional fluting and said fingers of said spring being passed through said tray parallel to said fluting.

10. The display stacker of claim 9 including, said tray being provided with holding means to receive said hooks whereby to prevent said tray from being removed from said stacker, and said stabilizing means being a connecting loop extending between said fingers.

11. The display stacker of claim 1 including, said torsion spring having a stabilizing means positioned against said back panel, said stabilizing means being a connecting loop extending between said fingers, said torsion spring having a pair of coils secured to said fingers distal to said hooks, said coils being inserted through said back panel and securing means in contact with said back panel securing said spring to said back panel while permitting pivotal movement of said fingers and said tray, said securing means being a dowel means inserted into said coils, said dowel means being on the side of said back panel opposite to said fingers, and said display stacker being formed from corrugated paper having conventional fluting and said fingers of said spring being passed through said tray parallel to said fluting.

12. The display stacker of claim 1 including, said side panels being folded back substantially the entire length of said side panels.

13. The display stacker of claim 1 including, a rear panel being spaced behind said back panel and positioned parallel to said back panel, said rear panel being integral with said side panels.

14. The display stacker of claim 13 including, tab means on said back panel and corresponding receiving slots on said rear panel to secure said back panel to said rear panel.

15. The display stacker of claim 1 including, each said tray being unsupported on said back panel except for said torsion spring.

16. The display stacker of claim 1 including, said trays being vertically spaced by an increment substantially equal to the height on the trays of the goods to be displayed.

* * * * *